US005585592A

United States Patent [19]

Stearns et al.

[11] Patent Number: 5,585,592

[45] Date of Patent: Dec. 17, 1996

[54] SHOCK TOLERANT FUZE

[75] Inventors: Edward J. Stearns; Philip J. Huerta, both of Scottsdale, Ariz.

[73] Assignee: Motorola, Inc., Schaumburg, Ill.

[21] Appl. No.: 251,147

[22] Filed: May 31, 1994

[51] Int. Cl.[6] ..... F42C 15/188; F42C 15/40

[52] U.S. Cl. ..... 102/233; 102/244; 102/251; 102/211; 102/216

[58] Field of Search ..... 102/254, 255, 102/256, 232, 233, 235, 244, 245, 251, 211, 216

[56] References Cited

U.S. PATENT DOCUMENTS

| | | | |
|---|---|---|---|
| 2,948,219 | 8/1960 | Sapp | 102/249 |
| 3,744,425 | 7/1973 | Grimm | 102/85 |
| 4,145,971 | 3/1979 | Graham et al. | 102/232 |
| 4,212,246 | 7/1980 | Eaton et al. | 102/270 |
| 4,380,197 | 4/1983 | Eaton | 102/228 |
| 4,470,351 | 9/1984 | Farace | 102/232 |
| 4,712,478 | 12/1987 | Haglund et al. | 102/424 |
| 4,739,705 | 4/1988 | Hudson et al. | 102/249 |
| 4,899,659 | 2/1990 | Hardt | 102/251 |
| 5,033,383 | 7/1991 | Edminster | 102/254 |
| 5,236,988 | 8/1993 | Doyama et al. | 524/404 |
| 5,387,257 | 2/1995 | Tari et al. | 102/226 |

FOREIGN PATENT DOCUMENTS

| | | | |
|---|---|---|---|
| 411996 | 2/1991 | European Pat. Off. | 102/254 |
| 1590204 | 2/1995 | France . | |
| 3904091 | 2/1995 | Germany . | |
| 2195007 | 3/1988 | United Kingdom . | |

OTHER PUBLICATIONS

MPEP, Nov. 1992, Parts Forum and Content of Application section 608.02, pp. 600–651.

European Search Report For EP 95 10 6709.

*Primary Examiner*—Stephen M. Johnson

*Attorney, Agent, or Firm*—Frederick M. Fliegel; Robert M. Handy

[57] ABSTRACT

A shock tolerant fuze includes a detector for determining when fuze timing should be initiated, a movable safe and arm assembly containing a time delay circuit and a firing aperture. The firing train detonator is preferably also mounted on the movable armature. When the fuze is armed, the time delay circuit is coupled to the detector and to the detonator, and the aperture provides a pathway between the output of the detonator and the remainder of explosive firing train of the weapon. Electrical energy storage is provided on the armature for powering the time delay circuit and the detonator in the event that primary power thereto is interrupted by impact. By including the time delay circuit and energy storage on the movable armature, a very shock tolerant fuze is obtained.

20 Claims, 9 Drawing Sheets

-PRIOR ART-

-PRIOR ART-

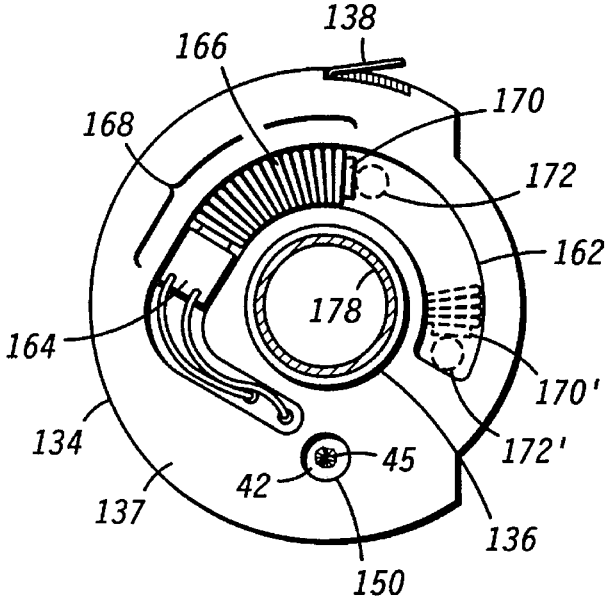
FIG. 8
FIG. 10
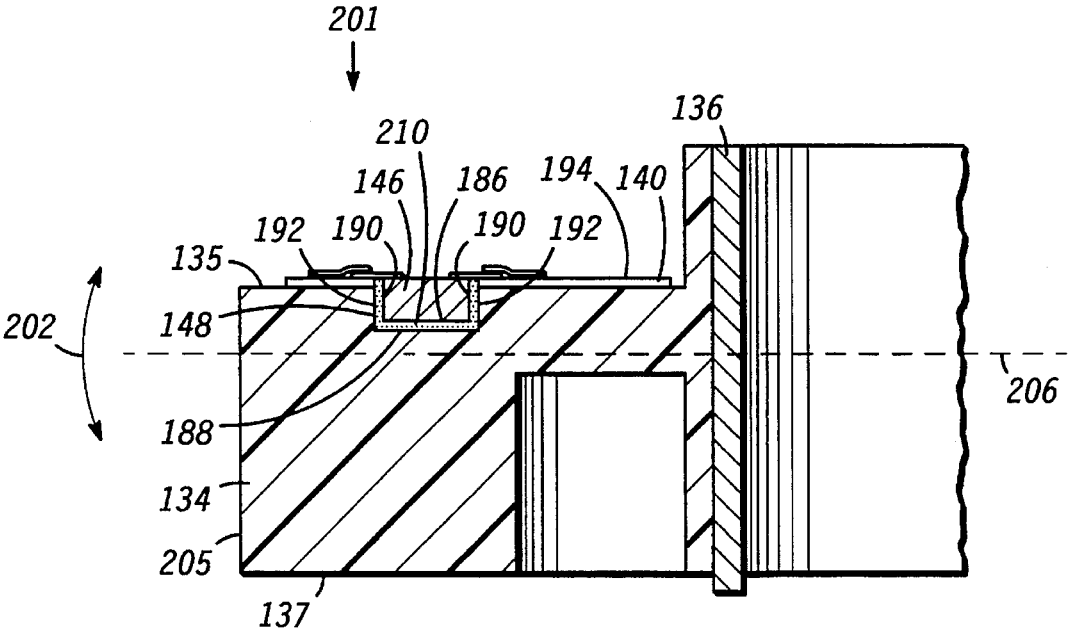

SHOCK TOLERANT FUZE

FIELD OF THE INVENTION

The present invention concerns an improved means and method for shock tolerant fuzes for explosive devices, including an improved means and method for shock tolerant safe and arm devices for explosive's detonators.

BACKGROUND OF THE INVENTION

High explosive devices such as, for example, artillery shells, bombs, rockets and other weapon warheads, must be capable of being handled safely under conditions of considerable stress and shock while at the same time be capable of reliably detonating at a predeterminable time before, during or after impact with the desired target. For convenience of reference, the word "weapon" as used herein is intended to include all forms of explosive devices, as for example but not limited to those listed above.

Most weapons employ a fire train for detonating the main explosive charge, that is, one or more progressively larger explosive devices which are detonated by a fuzing mechanism and which culminate in exploding the main powder charge. For example, an initial small explosive charge, often called a detonator is ignited by a firing pin or firing circuit. This initial small charge in turn ignites the main charge either directly or through one or more intermediate booster explosive charges. This sequence of charges is referred to as the fire train. As used herein, the word "fuze" is intended to refer to the combination of a fire train and its activating mechanisms or devices, and including any safe and arm mechanism or devices. A fuze may be located in the nose or base or elsewhere in the weapon, or there may be fuzes in multiple locations in the weapon, depending upon the user needs.

A "safe and arm" device is a mechanism which renders the fuze inert ("safe") while the weapon is being transported or handled so that it will not explode (even under shock conditions which would ordinarily set it off), and which, after the weapon is launched toward its target, turns on ("arms") the fuze so that subsequent activation thereof causes the weapon to explode.

In order to satisfy the conflicting requirements of safety and reliable detonation on target, it has been common in the art to employ out-of-line safe and arm devices as a part of the fuze which activates the weapon. An out-of-line safe and arm device is one in which a physical barrier is located in the explosive fire train to interrupt or physically block the detonation process of the fire train when the weapon is intended to be in the "safe" condition and removed therefrom when the weapon is intended to be in the armed condition. Various mechanisms are known in the art for accomplishing this.

A difficulty arises in employing conventional fuzes, such as is illustrated in FIGS. 1–2, when the weapon is intended to be used against hardened targets, as for example, targets protected by many feet or more of reinforced concrete or successive concrete walls separated by filled or empty regions. While conventional hard-target weapons (e.g., bombs, rockets or shells) may be capable of penetrating such reinforced structures, prior art fuzes have not always been able to provide reliable detonation timing following penetration. When attempting to destroy a bunker which may consist of successive chambers each separated and protected by reinforced concrete, it is highly desirable to be able to time detonation of the fuze so that the weapon reliably explodes in a particular location, e.g., after having penetrated through very massive reinforced concrete walls or a predetermined number of reinforced concrete walls and/or spaces.

Accordingly, there continues to be a need for an improved means and method for detonating explosive charges, especially for a fuze exhibiting great shock tolerance and at the same time providing out-of-line safe and arm capability.

SUMMARY OF THE INVENTION

It is an advantage of the present invention to provide an improved means and method for detonating explosive charges, especially to provide a fuze exhibiting great shock tolerance and reliable post-penetration timing with out-of-line safe and arm.

The foregoing and other advantages are provided by a fuze comprising a detector for determining when fuze timing should be initiated and a movable plate containing a time delay circuit and an aperture, wherein when the fuze is in an armed condition the aperture aligns a detonator ignited by the time delay circuit with further portions of the explosive firing train, and the time delay circuit is electrically coupled to the detector and to the detonator.

It is desirable that the time delay circuit comprises local back-up electrical energy storage means mounted on the movable plate for powering the time delay circuit and the detonator in the event that primary power to the timing circuit and detonator is interrupted. In a preferred embodiment, the electrical energy storage means comprises at least two back-up electrical energy storage means, one for powering the timing circuit and one for firing the detonator when action of the timing circuit is completed. The at least two back-up energy storage means desirably reside in recesses in the movable plate.

BRIEF DESCRIPTION OF THE DRAWINGS

FIG. 8 is a simplified rear plan view of the safe and arm rotor of the present invention.

FIG. 10 is a partial cut-away and cross-sectional view of the safe and arm rotor of the fuze, according to the present invention.

DETAILED DESCRIPTION OF THE DRAWINGS

Figure 1:
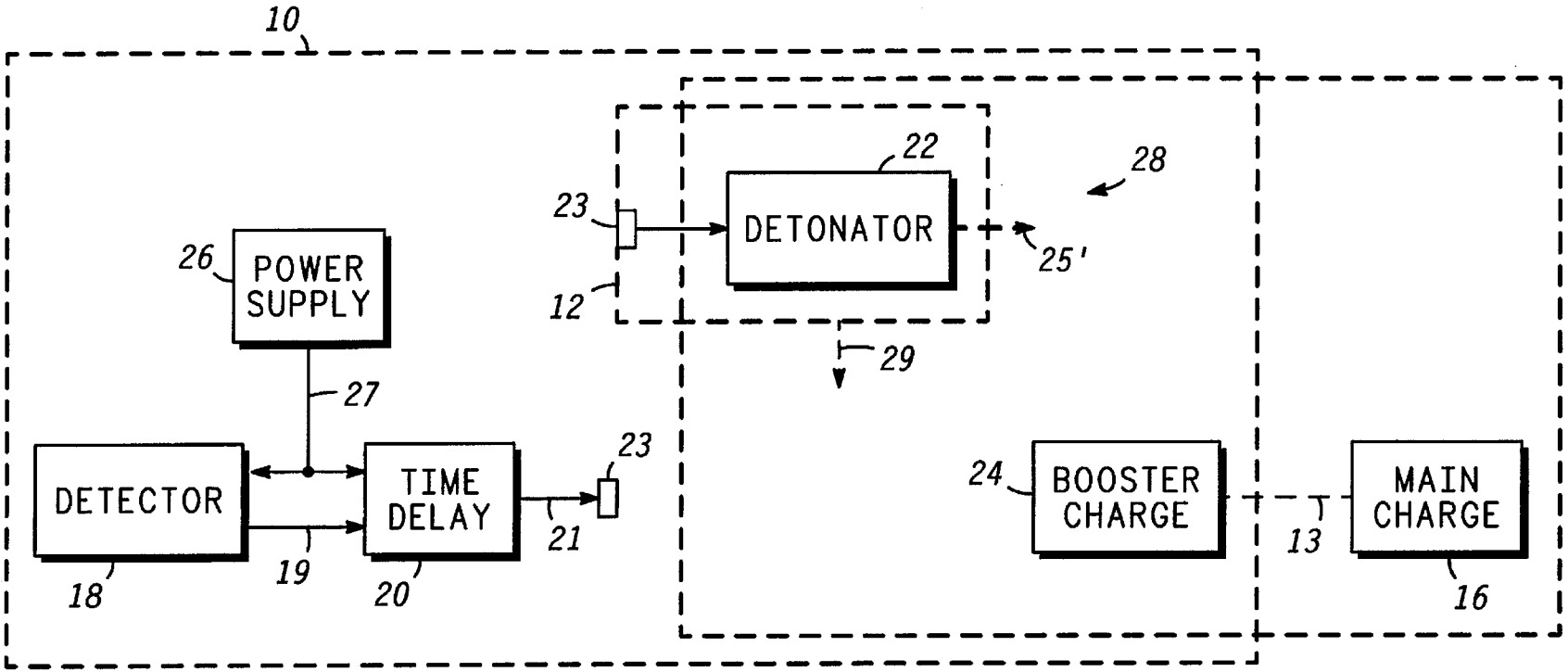
FIGS. 1–2 show in simplified schematic form, an example of a prior art fuze employing out-of-line safe and arm mechanism in the "safe" position (FIG. 1) and in-line in the armed position (FIG. 2).
Figure 2:
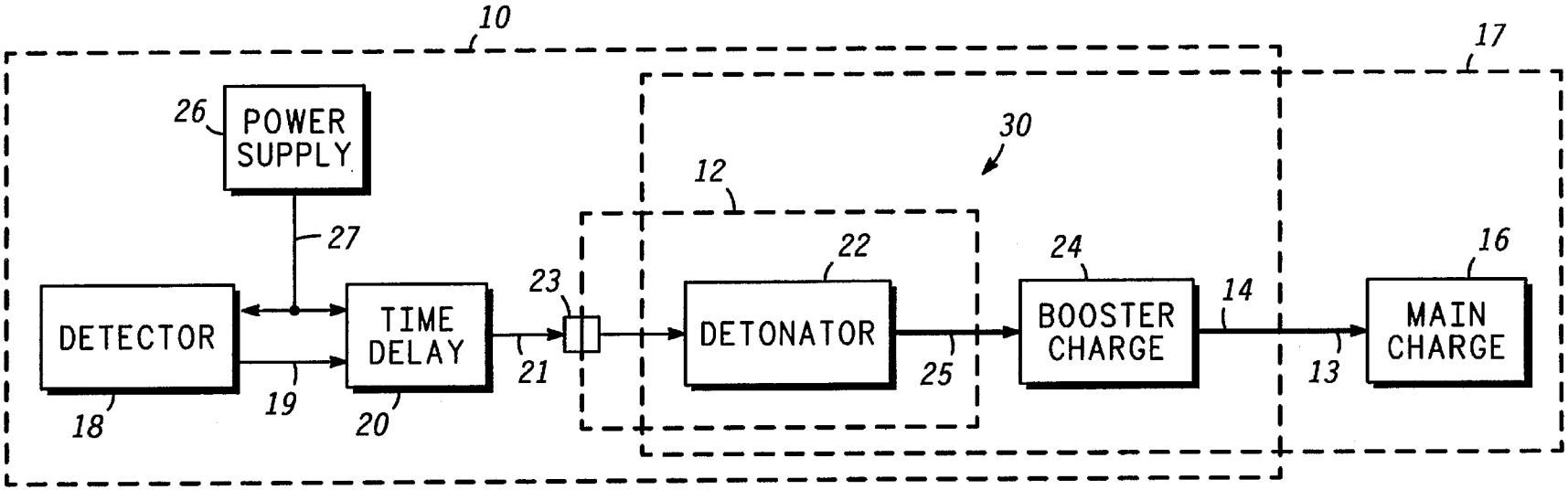

FIGS. 1–2 show in simplified schematic form, an example of prior art fuze 10 employing out-of-line safe and arm mechanism 12. Fuze 10 provides along path 13, explosive output 14 to detonate main explosive charge 16. Fuze 10 comprises impact or proximity detector or sensor 18, electronic time delay module 20, detonator 22 and optional booster charge 24 and power supply 26. Detonator 22, optional booster charge 24 and main charge 16 comprise firetrain 17.

Detector 18 provides an electrical signal along connection 19 to time delay module 20. Time delay module 20 performs the function of delaying detonation of the weapon for a predetermined time after detector 18 is actuated so as to insure that the maximum damage is inflicted on the target. The amount of time delay provided by module 20 is generally set prior to launching or firing the weapon. Electronic circuits for performing time delay are well known in the art.

Safe and arm unit 12 places detonator 22 in location 28 (see FIG. 1) which is out-of-line with booster charge 24 and main charge 16 in the "safe" position, and in location 30 (see FIG. 2) where detonator 22 is in-line with booster charge 24 and main charge 16 in the "armed" position. In this example, arming is accomplished by physically translating or rotating detonator 22 from out-of-line position 28 to in-line position 30 as indicated by arrow 29 after the weapon has been launched but before it has reached its target. Means for accomplishing this are well known in the art.

The electrical signal from time delay module 20 for firing detonator 22 is fed to detonator 22 via line 21 through separable connector or switch 23. Connector 23 is electrically "open" when detonator 22 is in position 28 (FIG. 1) and "closed" when detonator 22 is in position 30 (FIG. 2). This is a safety precaution to reduce the chance of an accidental misfire. Explosive output 25 produced when detonator 22 is fired can only communicate with booster charge 24 and main charge 16 when detonator 22 is in position 30. Otherwise it is absorbed harmlessly to the side of charges 24, 16 as indicated by dashed arrow 25'. Power supply 26 supplies electrical energy to detector 18 and time delay circuit 20 via path 27. The arrangement shown in FIGS. 1–2 is conventional.

Figure 3:
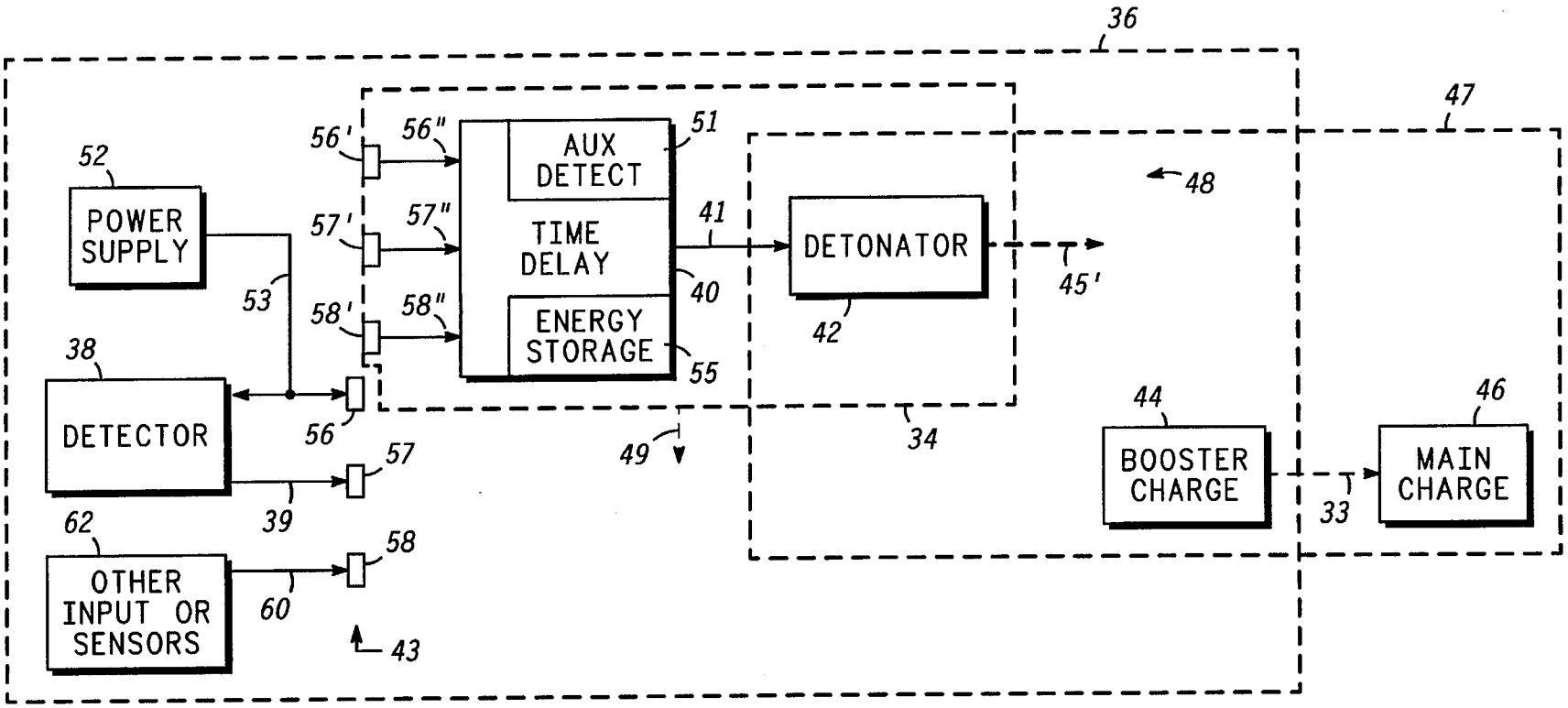
FIGS. 3–4 show in simplified schematic form, a fuze employing out-of-line safe and arm mechanism in the "safe" position (FIG. 3) and in-line in the armed position (FIG. 4), according to a first embodiment of the present invention.
Figure 4:
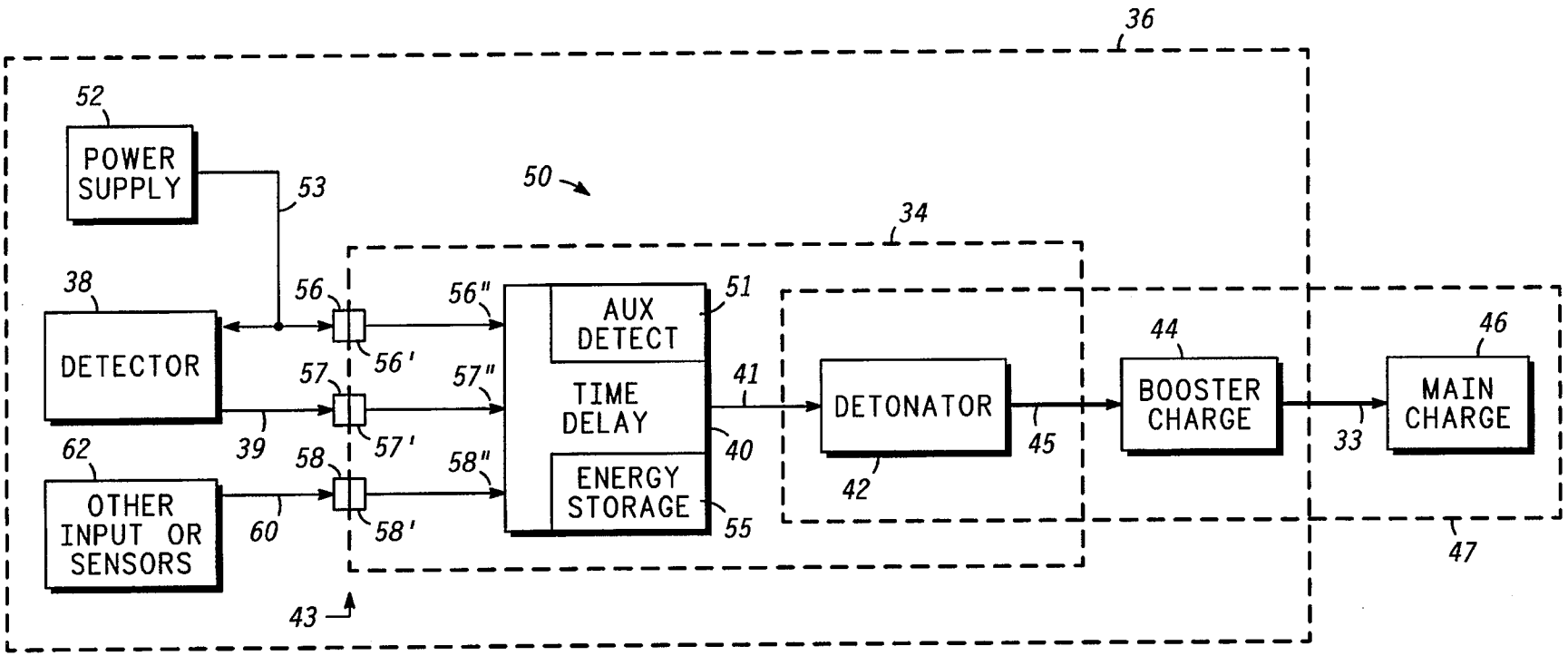

FIGS. 3–4 are simplified schematic diagrams similar to FIGS. 1–2, but generally illustrating the present invention. Fuze 36 according to the present invention comprises detector 38 analogous to detector 18, power supply 52 analogous to power supply 26, moveable safe and arm unit 34 and optional booster charge 44 analogous to booster charge 24. Main charge 46 is analogous to main charge 16. Detonator 42, booster charge 44 and main charge 46 comprise fire train 47.

Figure 6:
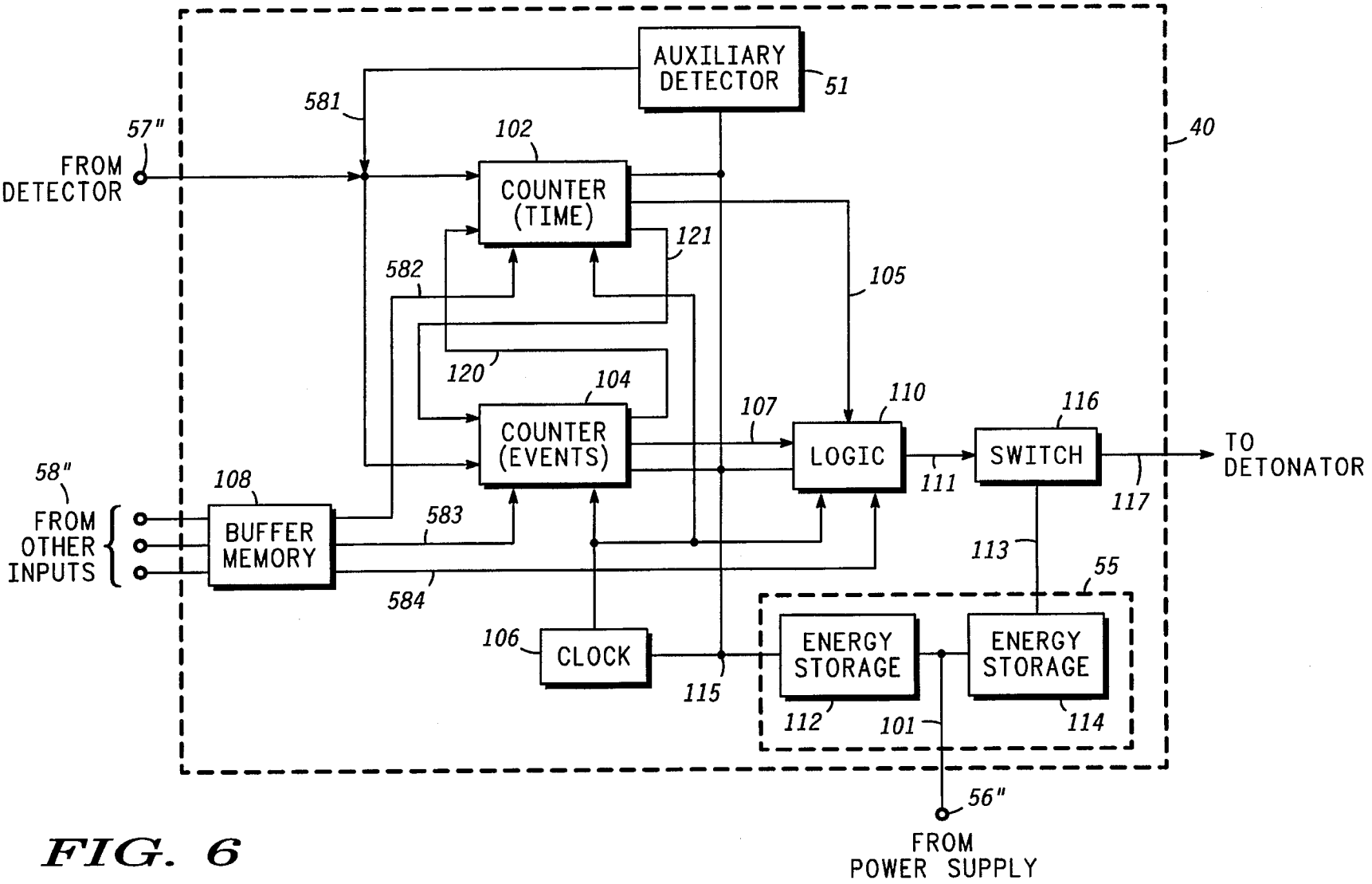
FIG. 6 is a simplified schematic block diagram illustrating a time delay circuit incorporating local energy storage, according to the present invention.

Detector 38 provides an electrical signal along connection 39 to time delay module 40. Time delay module 40 performs the function of delaying detonation of the weapon for a predetermined time after detector 38 is actuated so as to insure that the maximum damage is inflicted on the target. The amount of time delay provided by module 40 is generally set prior to launching or firing the weapon but may also be set at other times. A suitable time delay and firing circuit is shown in FIG. 6.

Safe and arm unit 34 places time delay module 40 and detonator 42 in location 48 (see FIG. 3) which is out-of-line with booster charge 44 and main charge 46 in the "safe" position, and in location 50 (see FIG. 4) where detonator 42 is in-line with booster charge 44 and main charge 46 in the "armed" position. In this example, arming is accomplished by physically translating or rotating safe and arm unit 34 containing detonator 42 and timer 40 from out-of-line position 48 to in-line position 50 as indicated by arrow 49 after the weapon has been launched but before it has reached its target.

The electrical signal from time delay module 40 for firing detonator 42 is fed to detonator 42 via connection 41. There need not be any separable connector in line 41 as in the prior art. Instead connector or switch 43 is provided between: (i) detector 38, other input or sensor modules 62 and power supply 52; and (ii) safe and arm mechanism 34 containing time delay circuit 40 and detonator 42. Connector 43 is electrically "open" so that the circuit is broken when safe and arm mechanism 34 is in position 48 (FIG. 3) and "closed" so that the circuit is completed when safe and arm mechanism 34 is in position 50 (FIG. 4). This is a safety precaution to reduce the chance of an accidental misfire. For safety reasons it is desirable to provide a common "ground" connection (not shown) to movable unit 34 in both positions 48, 50.

Explosive output 45 produced when detonator 42 is fired can only communicate with booster charge 44 and main charge 46 when detonator 42 is in position 50. Otherwise it is absorbed harmlessly to the side of charges 44, 46 as indicated by arrow 45'. Power supply 52 supplies electrical energy to detector 38 and time delay circuit 40 via path 53. It may also power other inputs and/or sensor units 62.

Connector 43 desirably has power supply portion 56 coupled to line 53 from power supply 52. Mating portion 56' is coupled to power input 56" of time delay module 40. Connector 43 has signal portion 57 coupled to line 39 from detector 38 and portion 58, optionally, to line 60 from other inputs or sensors 62. Mating portions 57', 58' couple to signal, respectively, to data inputs 57", 58" of timing module 40. Those of skill in the art will understand that connector portions 56, 56', 57, 57' and 58, 58' and lines 53 and 39, 60 may each have multiple contacts and/or conductors. Those of skill in the art will understand that time delay circuit or module 40 may be controlled by multiple inputs supplied via portions 57, 57', 58, 58' of connector 43, depending upon the particular weapon system in which fuze 36 is being employed. A non-limiting example of other inputs which may be fed to module 40 is the desired time delay to be provided by time delay circuit 40 and/or the number of walls or chambers to be penetrated by the weapon before detonation. Further, connector 43 may contain additional leads desired for performing other functions.

Figure 5:
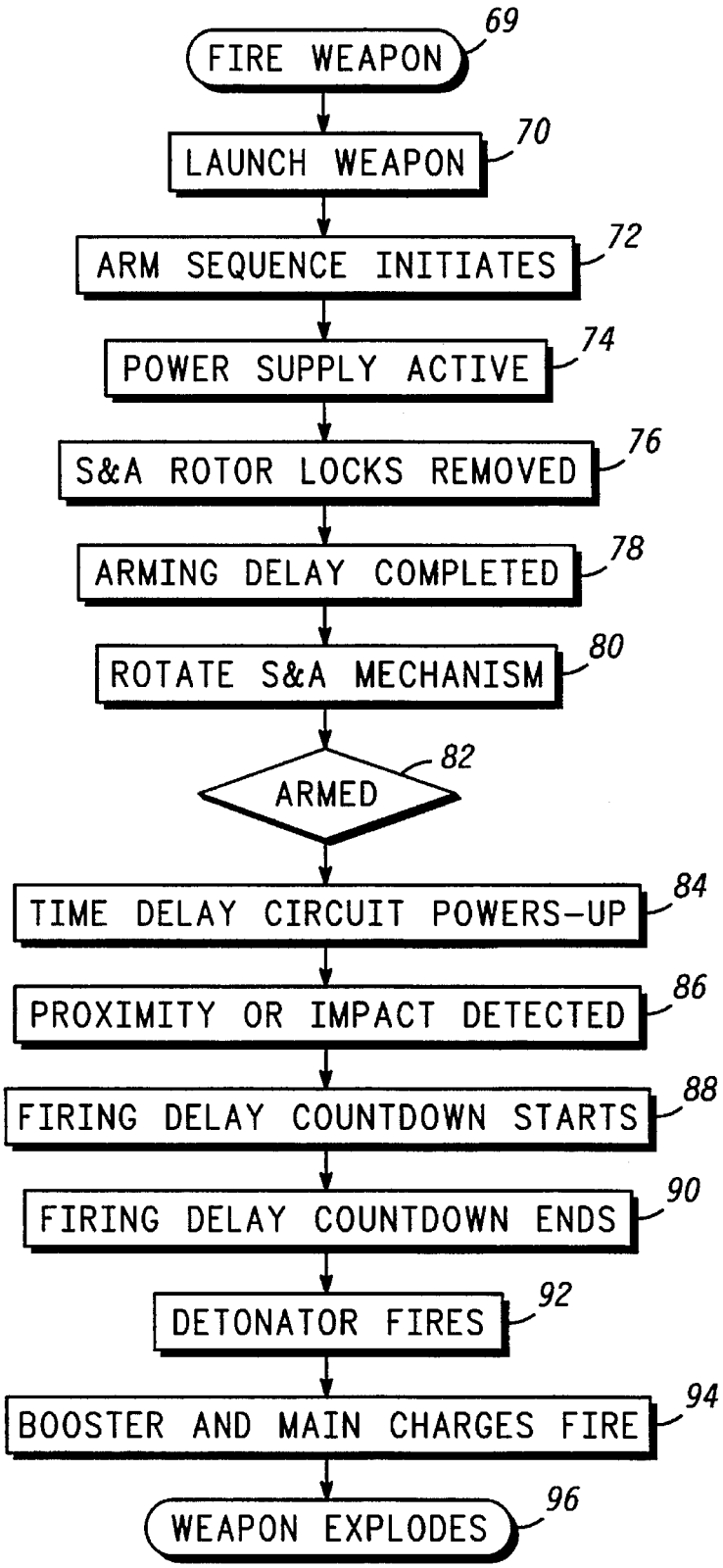
FIG. 5 shows in simplified form, a flow chart illustrating the operation of a weapon containing a fuze according to the present invention.

FIG. 5 illustrates the operation of the weapon and fuze illustrated in part in FIGS. 3–4. For purposes of explanation and not intended to be limiting, it is assumed that the safe and arm mechanism (S&A) is of the type that moves from the "safe" to the armed position by rotation, but this is not essential.

Weapon firing sequence 69 is initiated by launch weapon step 70. Conventional sensors within the weapon detect launch and the arm sequence initiates in step 72. For example, in spin stabilized weapons, a centrifugal force sensor detects the spin imparted by weapon launch, however, other means and methods may also be used. Power supply 52 (see FIGS. 3–4) becomes active in step 74 (or before) to be able to provide electrical energy to the fuze and other weapon components. A wind powered turbine generator is a non-limiting example of a power source suitable for use in weapons. Shock tolerant batteries are also suitable.

In step 76, locks intended to hold the safe and arm mechanism in the "safe" position are removed or disengaged. This may be accomplished, for example, by firing a squib or, in spin stabilized weapons, by centrifugal forces, which retract a "gag rod" which in turn removes a retaining pin engaging a notch or other aperture of the safe and arm rotor.

For safety reasons, most weapons have a built-in arming delay to insure that they travel a minimum distance away from the launch location before they are able to arm. In step 78 this arming delay is completed and the weapon is ready for arming. Steps 76 and 78 maybe interchanged. In step 80, for example, a squib is fired to rotate the safe and arm mechanism from the "safe" to the armed position, but other means known in the art may also be used for accomplishing this. The weapon is now armed as indicated at 82. Time delay circuit 40 powers up in step 84 by virtue of the closure of connector or switch 43 accomplished as a result of step 80. Detector 38 and other inputs and sensors 62 are also receiving power, which can be applied anytime after step 74.

It will be noted that steps 70–84 are accomplished before the weapon reaches the point in its flight where a target indication is received. Predetermined parameters such as, for example, desired time delay and/or desired impact counts are conveniently loaded into timer module 40 via line 60 and connector 43 (e.g., 58, 58', 58") after step 84 when arming is completed and power has been applied to timer 40 through connections 58, 58', 58". During this period between steps 84 and 86, local energy storage 55 (see FIGS. 3–4) is also charged from power supply 52 via connection 56, 56', 53, 56. Thus, after step 84, the weapon is ready to fire and awaiting target detection.

When proximity to a target or target impact is sensed by detector 38, as indicated in step 86, detector 38 sends a signal via line 39 through portion 57, 57' of connector 43 to time delay module 40 and the predetermined firing delay countdown starts as indicated in step 88. As used herein in connection with the present invention, the words "time delay" or "delay time" or "firing delay" or "firing delay countdown" or "fuze timing" are intended to include but not be limited to measuring elapsed time (e.g., the number of milliseconds from an impact or other target detection event) or counting the number of impacts (e.g., how many walls and/or spaces have been penetrated) or a combination thereof.

When the firing delay countdown ends in step 90, detonator 42 fires as indicated in step 92. Detonator 42 produces explosive output 45 which in turn ignites optional booster charge 44 and/or main charge 46, as indicated in step 94. When main charge 46 fires, the weapon explodes as indicated in 96. Sequence 69 is now completed.

A significant advantage of the present invention is that detonator 42 can be hard-wired to timing module 40. In prior art fuze 10 illustrated in FIGS. 1–2, lead 21 from time delay module 20 to detonator 22 passed through connector 23. When prior art fuze 10 impacts a hard target, connector 23 can be exposed to very large forces, for example, of the order of $10^3$–$10^5$ g. These forces can cause connector 23 to chatter or momentarily lose continuity. This can cause an error in fuze detonation if there is not a consistent and low resistance contact between time delay module 20 and detonator 22 at the moment that time delay module 20 has reached the end of the predetermined time delay.

By placing time delay module 40 on safe and arm mechanism 34, this prior art problem is avoided. Connector 43 is closed and continuity is established when safe and arm mechanism 34 is moved to "armed" position 50 before impact. Information from other inputs or sensors 62 can be received by time delay module 40 via connections 58, 58', 58" before impact. When detector 38 first senses target impact or proximity, continuity through connector 43 already exists so that the signal from detector 38 can move through connector 43 to start the countdown in time delay module 40. Even if switch 43 chatters during countdown, this has minimal effect since once the first detector impulse is received by module 40, the firing delay countdown starts (block 88, FIG. 5) and further communication with the remainder of fuze 36 is not essential. The energy to power circuit 40 and fire detonator 42 is already present in local energy storage 55 in timer module 40. When the countdown is completed, detonator 42 can reliably fire because connection 41 is unaffected by movement of connector 43 and firing energy is available locally even if connector 43 is momentarily in an open condition.

Having auxiliary detector 51 on safe and arm unit 34 is advantageous under circumstances where detector 38 may be destroyed or damaged on impact. With this embodiment, the target detection (block 86), time delay (blocks 88, 90) and firing functions (blocks 92, 94, 96) are independent of detector 38, power supply 52 and other inputs and sensors 62 once fuze arming and set up is completed. Even if impact damages or destroys sensor 38, power supply 52, other inputs and sensors 62 and/or connector 43, fuze 36 will still function properly.

Thus, the arrangement illustrated in FIGS. 3–4 provides an inherently more reliable fuze 36 for hard target applications.

FIG. 6 is a simplified schematic block diagram of time delay module 40 incorporating local energy storage 55, useful in the present invention. Module 40 comprises one or both of programmable counters 102 and 104, clock or timer 106, control input buffer memory 108, optional auxiliary detector 51, programmable logic circuit 110, first energy storage means 112, second energy storage means 114 and switch 116. Clock 106 provides a convenient time base for operation of counters 102, 104 and switching of logic circuit 110. In FIG. 6, DC power supply lines are shown without arrows and logic or other signal lines are shown with arrows.

Auxiliary detector 51 is optionally provided within module 40 and functions substantially in the same manner as detector 38. By having detector 51 mounted on rotor assembly 34, there is no need to transfer a target detection signal across connector 43. This is advantageous under circumstances when connector 43 may be subject to significant forces at the same time that an "impact" signal needs to be transferred across connector 43 from detector 38 to time delay module 40, or when detector 38 is damaged or destroyed on impact and cannot provide the needed target detection signals.

Counters 102, 104 are desirably programmable counters, that is, adapted to have the desired count and/or mode of operation able to be set externally. For example, using count-down counters, the total desired count is pre-loaded into counters 102, 104 using lines 582, 583 via buffer 108 from input 58" after event 84 and before event 86 in FIG. 5. Then, when a target detection impulse arrives via line 581 from detector 38, 51, counters 102, 104 begin to count down. When the count reaches zero, counters 102, 104 (depending upon which one is active) provide output(s) on lines 105, 107, 120, 121 as explained below. Such counters are conventional.

Counter 102 is provided to count elapsed time using the output of clock 106 as a time base. Counter 104 is provided to count events, as for example, the number of pulses (e.g., corresponding to penetration events) received from detector 38, 51. Either one or of both counters 102, 106 may be provided in time delay module 40, or a single counter may be used and placed in either mode of operation by an external control signal fed through input 58" prior to impact. Either arrangement is useful. However, having separate counters 102, 104 provides greater flexibility of fuze programming. For convenience of explanation, the arrangement of having both counters 102, 104 present is shown and described in FIG. 6 and associated text.

Signals arriving on lines 582, 583 via buffer 108 tell counters 102, 104 whether or not to count in response to pulses received from detector 38, 51. For example, if the fuze is desired to fire after a predetermined time delay, then counter 102 is set to start counting clock pulses on the first pulse received from detector 38, 51 and to ignore subsequent detector output and counter 104 is disabled. If fuze 36 is desired to fire after a predetermined number of penetration events, where each event causes detector(s) to 38, 51 emit a pulse, then counter 102 is disabled and counter 104 is set to count successive detection events, i.e., successive detector output pulses. Alternatively, fuze 36 may be set to fire when a specific combination or sequence of events has occurred, for example, N milliseconds after penetrating the third internal wall of the bunker. In this mode of operation, counter 104 is enabled to count input pulses on line 581 and counter 102 is enabled via line 120 to count clock pulses after counter 104 has reached its intended count. Similarly, the sequence can be reversed, and counter 102 enabled to count clock pulses for a predetermined number of milliseconds and thereafter trigger counter 104 via line 121 to count subsequent penetration events. Persons of skill in the art will understand based on the description herein that a wide range of circumstances may be accommodated using the present invention.

Counters 102, 104 provide output signals to each other on lines 120, 121 and to logic circuit 110 on lines 105, 107. Logic circuit 110 is desirably programmable by an input from the fuze setting controls or logic received via input 58" and buffer 108 on line 584. The control input on line 584 is correlated with the control inputs on lines 582–583 such that circuit 110 delivers to switch 116 via line 111 a firing signal when the correct count or combination of counts has been determined by counters 102, 104 or both. For example, if firing is desired to occur after either of counters 102, 104 has reached zero count, then logic circuit 110 functions as an "OR" circuit. If firing is desired to occur after both have reached zero count, then circuit 110 functions as an "AND" circuit. Programmable logic circuits are well known in the art.

The combination of energy storage means 112, 114 provides energy storage 55 of FIG. 3–4 which is charged via input port 56" and line 101. Energy storage 55 is desirably divided into at least two independent energy storage means 112, 114 as shown in FIG. 6. Energy storage 114 supplies detonator 42 via line 113 and switch 116. Energy storage 112 supplies the remainder of time delay module 40 via line 115. By having independent sources of electrical energy for time delay/firing circuit 40 and detonator 42, firing reliability is not affected by variations in the time delay and/or counts which take additional energy from energy storage 112. As explained in connection with FIG. 7, capacitors 146, 146' conveniently serve as energy storage means 112, 114, but other energy storage means well known in the art may also be used. Non-limiting examples of other storage means are batteries.

Switch 116 is an electrically operated switch, preferably a semiconductor switch, as for example a transistor or other controllable semiconductor switching device. An SCR is suitable. Switch 116 receives a firing signal from logic circuit 110 and, in response thereto, couples separate energy storage means 114 to detonator 42.

Because energy storage 55 and timing and firing module 40 are located on rotor 134, operation of module 40 and firing of detonator 42 does not depend on unbroken continuity through connector 43. Further, since data controlling operation of module 40 and the energy necessary for time delay operation of module 40 and firing of detonator 42 are loaded into module 40 before impact, operation of fuze 36 is more impervious to large g forces caused by impact than are prior art programmable fuzes. These are particular features of the present invention.

Figure 7:
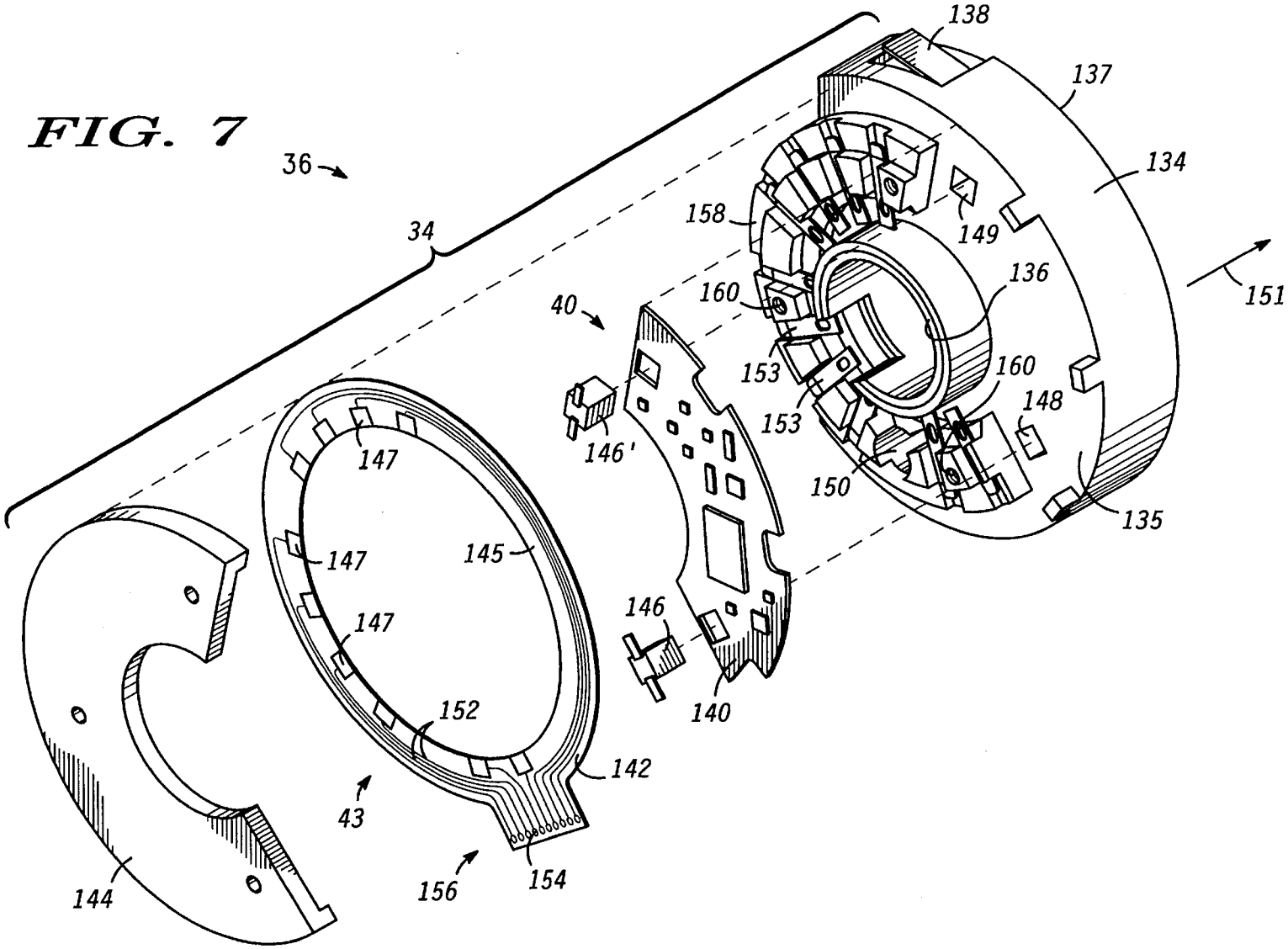
FIG. 7 is an exploded isometric view of a portion of a fuze according to a preferred embodiment of the present invention and showing greater detail.

FIG. 7 is an exploded isometric view of a portion of fuze 36 according to a preferred embodiment of the present invention and showing greater detail. FIG. 7 should be considered in combination with FIGS. 4–5 and 8–10. Safe and arm mechanism 34 comprises rotor 134, center rotor bushing 136, rotor detent locking spring 138, time-delay and firing circuit printed circuit board assembly 140, contact ring 142, and circuit board cover 144. Elements 134, 136, 138, 140, 142 and 144 form safe and arm rotor assembly 34.

Rotor 134 is supported by center stainless steel bushing 136 which is conveniently pressed into rotor 134. Bushing 136 provides support for rotor 134 and is the primary load path during a high g shock environment. Rotor 134 is independent of the inertial loading of fuze 36 and only needs to support its own weight and that of circuit board 140 (and included components), ring 142 and cover 144 during high impact loading. Rotor 134 is preferably an injection molded structure, the preferred material being a glass-filled liquid crystal polymer which is more commonly known by its trade name, VECTRA™.

Figure 9:
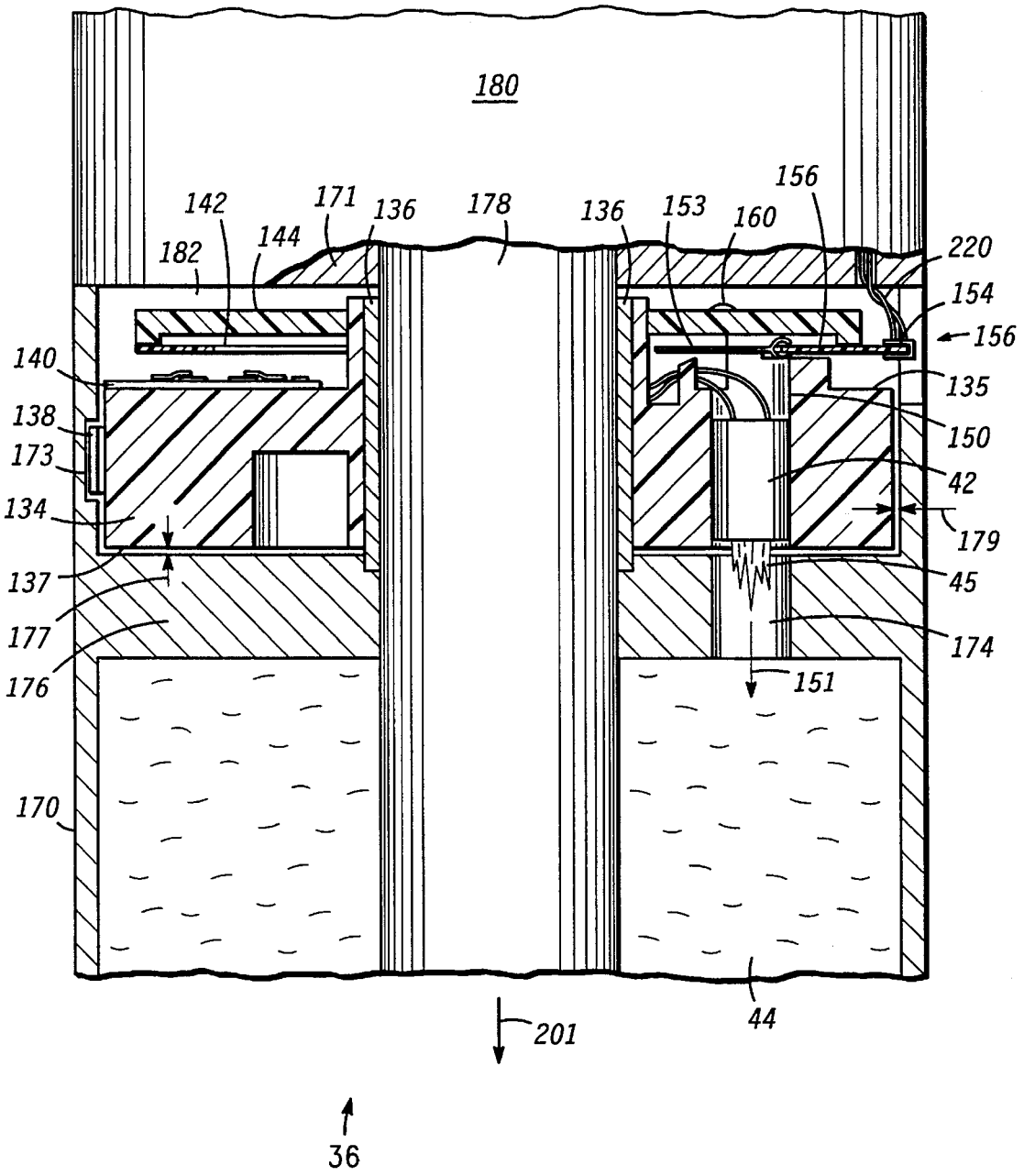
FIG. 9 is a partial cross-sectional and cut-away view in simplified form of a fuze according to a preferred embodiment of the present invention and showing further details.

Rotor 134 rotates from safe position 48 to arm position 50 (see FIGS. 3–4) around central shaft 178 passing through bushing 136 (see FIGS. 8–9). Spring lock 138 locks rotor 134 to safe and arm housing 170 when in armed position 50 once rotor 134 has reached the end of its rotary travel (see FIG. 9). This insures that rotor 134 will not move from the armed condition under the high g shock forces produced by impact with a target.

Module 40 comprises printed circuit board (PCB) 140 bonded to a flat area on upper surface 135 of rotor 134 and its included electrical components and interconnections. Two cavities 148, 149 are located in rotor 134 to provide support for energy storage devices 146, 146', respectively. Energy storage devices 146, 146' are preferably tantalum capacitors. B-stage epoxy, as for example, ABELFILM™ type 561k made by Abelstick, Inc. of California, is used to bond PCB 140 to top side 135 of rotor 134. Epoxy is also used to support the surface mount electrical components and contacts on PCB 140 and to aid in holding capacitors 146, 146' in cavities 148, 149. SCOTCHWELD™ type 2216 epoxy manufactured by the 3M Company of St. Paul, Minn. is suitable. It is desirable to apply epoxy fillets 210 around capacitors 146, 146' and other large components.

Detonator 42 is conveniently located in hole 150 in rotor 134 (see FIGS. 8–9). Detonator 42 fires out of bottom side 137 of rotor 134 opposite to upper surface 135, i.e., in the direction of arrow 151 in FIGS. 7 and 9.

Electrical connection between the time delay circuit on PCB 140 and/or rotor 134 (e.g., module 40) and the fuze primary electronics (not shown) is provided via rotary switch or connector 142 and mating contacts 153 on PCB 140. Connector 142 and sliding contacts 153 provide connector 43 of FIGS. 3–4. Connector 142 comprises printed circuit board (PCB) 145 on which are located metal contacts 147, 154 and metal traces 152.

Flexible wires 220 are conveniently used to make electrical connections from the fuze primary electronics to connection points 154 on connector 142 (see FIG. 9). Other wires are used to couple contacts 153 on rotor 134 (which engage contacts 147 on connector 142) to module 40 formed on PCB 140. PCBs 140, 145 are preferably made from a polyimide material. Annular connector 142 does not rotate, but is conveniently keyed to the safe and arm housing 170 (see FIG. 9) by feature 156 which protrudes from its outside periphery and fits in a mating cutout in safe and arm housing 170. When safe and arm mechanism 34 is assembled, annular connector 142 lies over recessed annular region 158 of rotor 134 and is prevented from separating from rotor 134 by cover 144. Cover 144 is preferably a molded or cast polycarbonate disk with a slight peripheral lip facing toward rotor 134. Cover 144 is conveniently fastened to bosses 160 on rotor 134 by threaded fasteners. It serves to retain and protect annular connector 142.

FIG. 8 is a simplified rear plan view of safe and arm rotor 134 according to a preferred embodiment of the present invention, comprising groove or opening 162 in which is located explosive squib 164 attached to bellows 166, which together form rotor bellows motor 168. Hole or passageway 150 is provided to allow explosive output 45 from detonator 42 located in hole 150 to escape and ignite charges 44, 46 (see FIG. 4).

End 170 of bellows motor 168 engages a reference feature or pin indicated by dashed outline 172. Central shaft 178 passing through bushing 136 is fixed to external housing 170 (see FIG. 9) enclosing safe and arm rotor 134. Rotor 134 rotates on shaft 178 with respect to housing 170 when squib 164 is fired. Rapidly expanding gases from the explosion of squib 164 force bellows 166 to extend around circular channel 162, thereby causing rotor 134 to rotate in a counter-clockwise direction in FIG. 8 around central shaft 178 on bushing 136 until end 170 and pin 172 are in relative locations 170', 172' respectively near the end of channel 162. This places rotor 134 in the armed position. Spring 138 engages groove or notch 173 on the interior of housing 170 to lock rotor 134 in the armed position (see FIG. 9). The stiffness of the extended bellows 166, as well as the spring detent lock described above, insure that rotor 134 does not move from its 'in-line' armed position during weapon target penetration. In the preferred embodiment, the electrical signals to fire squib 164 are made via contacts (not shown) on connector 142 which provide continuity to squib 164 when rotor 134 is in the "safe" position, but any convenient means may also be used.

Blow-through hole 150 in rotor 134 provides a path for explosive output 45 of detonator 42 to impact explosive booster 44 only when rotor 134 is in armed position 50, wherein detonator 42 and hole 150 are aligned with hole 174 in bulkhead 176 separating rotating safe and arm unit 34 from booster charge 44 (see FIGS. 3–4 and 9). If desired, explosive output 45 can impact an explosive lead charge (not shown) located within hole 174 which, in turn, ignites booster charge 44.

FIG. 9 is a partial cross-sectional and cut-away view along a plane passing approximately longitudinally through fuze 36, in simplified form showing further details. Fuze 36 comprises housing 170, booster charge 44, safe and arm rotor 134, detonator 42, time delay circuit board 140 comprising time delay module 40, annular connector ring 142 of movable connector 43 (see FIGS. 3–4), safe and arm cover 144, and separator or partition plate 171. In FIG. 9, rotor 134 is shown in the armed position with spring 138 engaged in detent 173 in housing 170. In this position detonator 42 in hole 150 is aligned with hole 174 in transversal partition 176 of housing 170 so that explosive output 45 may pass from detonator 42 to booster charge 44 when detonator 42 is fired. Other portions of the fuze, as for example, detector 38, other input or sensors 62 and power supply 52 are conveniently contained in fixed portion 180 of housing 170, but this is not essential.

Rotor assembly 34 is conveniently contained within cylindrical cavity 182 of housing 170. Rotor assembly 34 comprising rotor 134, circuit board 140 with time delay module 40, connector ring 142 and cover 144, is free to rotate when not constrained by a lock. The bearing surface upon which bushing 136 rotates is center stainless steel rod 178. In the safe position, the rotor is locked in position by what is known in the art as a "gag rod" (not shown), which intrudes into a cutout feature in the rotor hub and bushing, and locks it in relation to housing 170. Upon command from the fuze primary electronics, housed for example, in portion 180, a piston actuator moves the gag rod and retracts the lock, engaging rotor 134. After a further time delay the fuze primary electronics fires bellows motor 168, which rotates rotor 134 to armed position 50. Rotor 134 is locked in armed position 50 by the combination of spring 138 attached to rotor 134 and detent 173 in housing 170, and by the stiffness of extended bellows 166.

Safe and arm housing 170 is conveniently made from 4340 heat treated steel. It is rugged and shock survivable. It is designed to withstand the high g impact loading likely to be encountered by deep penetration weapons. The machining tolerances on housing 170 are such that rotor 134 may move freely within housing 170 around rod 178 without binding while at the same time being a sufficiently close fit axially and laterally to prevent excessive movement of the rotor within assembly housing 170. Minimizing the movement minimizes the impact forces rotor 134 is subjected to, contributing to its high impact survivability. In a preferred embodiment, clearance 177 between rotor 134 and housing partition 176 is conveniently about 2–10 mils with about 4–6 mils being preferred, and clearance 179 between the outer the periphery of rotor 134 and the inner wall of housing 170 is conveniently in the range of about 10–40 mils with about 20–30 mils being preferred. However, larger or smaller clearances may be used depending upon the application and anticipated load forces.

A small gap similar in size to gap 177 normally exists between the exposed upper end of rotor bushing 136 and partition 171 separating rotor cavity 182 from other portion 180 of housing 170 when the lower end of bushing 136 is seated on partition 176. In the event that weapon impact causes upper partition 171 to deform toward cavity 182, further collapse of partition 171 is resisted by bushing 136. The compressive force is transferred through bushing 136 to lower partition 176. This protects space 182 containing rotor assembly 34 so that time delay and firing circuit 40 on rotor 134 can continue to function even though forward portion 180 of fuze 36 has suffered substantial damage.

Electrical signal and power coupling to circuit 40 on rotor 134 is made via annular printed circuit board (PCB) 142. Annular connector board 142 is conveniently hard wired to the primary fuze electronics via wires 220 and couples to time delay/firing circuit board 140 on rotor 134 via sliding connectors 153. Rotor 134 rotates relative to annular connector board 142. Rotor 134 contains electrical contacts 153 which slide over conductive tracks 152, 147 on connector board 142, thus closing and opening circuit paths to time delay module 40 on printed circuit board 140 mounted on rotor 134. Contacts 153 are conveniently hard wired to module 40.

FIG. 10 is a partial cut-away and cross sectional view through the portion of rotor 134 and circuit board 140 in which capacitor 146 is located. Capacitor 146' has an analogous arrangement with respect to rotor 134 and circuit board 140. FIG. 10 illustrates the substantial support provided by surface 135 of rotor 134 for time-delay/firing PCB 140 of module 40. Cavities 148, 149 (see also FIG. 7) provide multi-axial support for energy storage units, e.g., capacitors 146, 146'. Capacitors 146, 146' are supported from five sides, that is, bottoms 186 of capacitors 146, 146' are supported by bottoms 188 of recesses 148, 149, and sides 190 of capacitors 146, 146' are supported by sides 192 of recesses 148, 149. Epoxy 210 is used to bond capacitors 146, 146' to sidewalls 192 and bottom 188 of recesses 148, 149 in rotor 134. It is desirable that epoxy 210 be void free. Capacitors 146, 146' are electrically connected via flexible wires that feed through holes in PCB 140 and solder to tabs or contact regions on upper surface 194 of PCB 140. This decouples the weight (at high g) of capacitors 146, 146' from their soldered electrical connections, contributing to their reliable performance during the high shock environment.

The thick cross-section of rotor 134 provides resistance to bending of rotor 134 in a direction shown by arrow 202 in response to deceleration forces in the direction of arrow 201. This in turn minimizes stresses on PCB 140 and on solder joints and electrical components mounted thereon during the high g shock encountered during weapon impact. The inertial weight of rotor assembly 34 during high g loading as indicated by arrow 201 is supported primarily by center stainless steel bushing 136. The load of rotor assembly 34 is transferred via bushing 136 to partition 176 of safe-and-arm housing 170 (see FIG. 9). Bushing 136 bears against a small counter bore in partition 176. Bushing 136 protrudes from the base of rotor 134 by a small amount consistent with the depth of the counter bore such that, in the assembled state there is a small gap 177 as previously described. This insures that rotor 134 is free to rotate when bellows motor 168 is activated.

Bottom 188 of recess 148, 149 is located proximate an interior plane or surface shown by dashed line 206. It was found that if capacitors or other energy storage units 146, 146' were mounted on upper surface 135 of rotor 134 or on circuit board 140, they tended to pop under high g during penetration of a hardened target. This would render the fuze inoperative.

It is believed that the deceleration forces (shown by arrow 201) created by the impact of the weapon against a hard target causes perimeter 205 of rotor 134 to bend up and/or down relative to its center bushing 136, as indicated by arrows 202. When units 146, 146' are mounted on upper surface 135 of rotor 134 or on circuit board 140, this flexure can cause them to experience large shear forces, which can result in failure of the electrical components or of the cement or solder attaching them to board 140 and/or rotor 134. Further, such large forces can cause internal damage within energy storage units 146, 146' so that their stored electrical charge is prematurely dissipated. This problem was eliminated by placing energy storage units 146, 146' in recesses 148, 149 surrounded by epoxy cement 210. Further, placing units 146, 146' in recesses 148, 149 resulted in lower surfaces 186 of units 146, 146' being located on surface 188 which experiences less stress and strain than upper surface 135 of rotor 134. Thus, it is preferred to locate the capacitors or other energy storage components or any other comparatively larger or massive components in this manner to reduce the likelihood of failure.

Fuzes constructed according to the preferred embodiment described above were tested in a bomb type weapon launched against reinforced concrete targets of at least six feet thickness so as to simulate impact with a hardened bunker. Weapon impact velocities were above about $10^3$ feet/sec and impact deceleration loading on the fuzes exceeded $10^4$ g. In all cases the weapon penetrated the six foot thick reinforced concrete targets without adverse affect on the fuzes. The fuzes continued to operate despite the very large g forces sustained during impact and penetration. The fuzes fired the detonators within a few milliseconds of the pre-programmed delays of about 70 milliseconds. These results show that the invented configuration described above provides superior shock survivability in a fuze embodying an out-of-line safe and arm mechanism.

In these test fuzes, rotatable armature 134 was about 2.5 inches in diameter and with a thickness of about 0.5 inch, housing 170 had an outer diameter of about 2.75 inches, the safe and arm portion of the housing was about 2.25 inches long and the overall housing length including portion 180 containing the remainder of the weapon electronics and time delay setting controls was about 6 inches.

Based on the foregoing description, it will be apparent to those of skill in the art that the present invention has the advantages set forth earlier, namely, to provide a weapon having improved means and method for detonating explosive charges, especially to provide a fuze exhibiting great shock tolerance and reliable penetration time delay, and at the same time incorporating out-of-line/in-line safe and arm capability. A further advantage of the present invention is that it is of comparatively small size and therefore useful in a wide range of weapons. A still further advantage is that it employs only a small number of moving parts and is therefor simple to assemble, maintain and operate and resistant to disabling deformation on impact.

While the present invention has been described in terms of particular materials, structures and steps, these choices are for convenience of explanation and not intended to be limiting and, as those of skill in the art will understand based on the description herein, the present invention applies to other choices of materials, dimensions, arrangements and process steps, and it is intended to include in the claims that follow, these and other variations as will occur to those of skill in the art based on the present disclosure.

What is claimed is:

1. A shock tolerant fuze for a device containing an explosive, comprising:

a detector for determining when fuze timing should be initiated; and a movable plate containing a time delay circuit and an aperture, wherein when the fuze is in an armed condition the aperture aligns a detonator ignited by the time delay circuit with the explosive and the time delay circuit is electrically coupled to the detector and to the detonator.

2. A fuze as claimed in claim 1 wherein the detonator and the time delay circuit are co-located on the movable plate.

3. A fuze as claimed in claim 1 wherein the time delay circuit comprises local electrical energy storage means mounted on the movable plate for powering the time delay circuit and the detonator when primary power to the time delay circuit and detonator is interrupted.

4. A fuze as claimed in claim 3 wherein the electrical energy storage means comprises at least two independent electrical energy storage units, one for powering the time delay circuit and one for powering the detonator when action of the time delay circuit is completed.

5. A fuze as claimed in claim 4 wherein the at least two independent electrical energy storage units comprise capacitors.

6. A fuze as claimed in claim 4 wherein the at least two independent electrical energy storage units reside at least partially in recesses in the movable plate.

7. A fuze as claimed in claim 6 wherein the recesses have sides and bottoms extending into the movable plate and wherein the bottoms face toward a deceleration force arising from impact of the fuze with a target.

8. A fuze as claimed in claim 1 wherein the movable plate has a front surface containing the time delay circuit and an opposed rear surface and wherein an actuator for moving the movable plate from a "safe" to an "armed" position is coupled to the opposed rear surface.

9. A fuze as claimed in claim 8 wherein the actuator is located in a groove in the opposed rear surface.

10. A fuze as claimed in claim 8 wherein the actuator comprises a bellows motor.

11. A fuze as claimed in claim 1 wherein the movable plate comprises liquid crystal polyester material.

12. A fuze as claimed in claim 1 wherein the movable plate comprises an annularly shaped plastic body laterally enclosing a tubular central metal core.

13. A fuze as claimed in claim 1 wherein the fuze further comprises a latch for retaining the movable plate in an armed position once armed.

14. A fuze as claimed in claim 1 further comprising a connector for coupling the time delay circuit to the detector in the armed condition and decoupling the time delay circuit from the detector in a safe condition.

15. A fuze as claimed in claim 1 wherein the time delay circuit is electrically coupled to the detonator by a fixed connection and electrically coupled to the detector by a movable connection which is open when the movable plate is not in the armed condition.

16. A shock tolerant fuze comprising a detonator, a detector for determining when fuze timing should be initiated, and a movable safe and arm mechanism containing a time delay circuit, electrical connections for the time delay circuit and a firing aperture, wherein when the safe and arm mechanism is located so that the fuze is in a safe condition, the electrical connections are open and the firing aperture does not provide a pathway between an output of the detonator and an explosive charge, and when the safe and arm mechanism is located so that the fuze is in an armed condition, the time delay circuit is coupled to the detector, the electrical connections are completed and the firing aperture provides a pathway between said output and the explosive charge.

17. A fuze as claimed in claim 16 wherein the time delay circuit is coupled to the detonator in both safe and armed conditions and to the detector only in the armed condition.

18. A fuze as claimed in claim 16 wherein the time delay circuit is coupled to both the detonator and an auxiliary detector in both safe and armed conditions.

19. A fuze as claimed in claim 16 wherein local electrical energy storage is provided on the movable safe and arm mechanism for powering the time delay circuit and the detonator when primary power thereto is interrupted.

20. A deep penetration weapon having an out-of-line safe and arm fuze for detonating the deep penetration weapon during or after penetration of a target, wherein the deep penetration weapon comprises in the out-of-line safe and arm fuze, a power supply, a detector for detecting one or more target impacts, a detonator, a firing aperture to allow the detonator output to communicate with an explosive charge, a delay circuit for firing the detonator after a predetermined delay in response to a signal received from the detector, and a movable connector for coupling the power supply to the delay circuit, wherein the detonator, delay circuit and portions of the connector are mounted on a movable armature containing the firing aperture, and when the movable armature is moved from a safe to an armed position, the connector completes an electrical circuit between the power supply and the delay circuit and the aperture and the detonator align with the explosive charge.

* * * * *